US006652063B1

(12) United States Patent
Shimamura et al.

(10) Patent No.: US 6,652,063 B1
(45) **Date of Patent: *Nov. 25, 2003**

(54) INK JET RECORDING APPARATUS

(75) Inventors: Yoshiyuki Shimamura, Yokohama (JP); Masanori Kaneko, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,087

(22) Filed: Oct. 17, 2000

Related U.S. Application Data

(62) Division of application No. 08/575,462, filed on Dec. 20, 1995, now Pat. No. 6,189,996, which is a continuation of application No. 08/032,697, filed on Mar. 17, 1993, now abandoned, which is a continuation of application No. 07/654,035, filed on Feb. 12, 1991, now abandoned.

(30) Foreign Application Priority Data

| | | |
|---|---|---|
| Feb. 13, 1990 | (JP) | 2-29397 |
| Feb. 13, 1990 | (JP) | 2-29497 |
| Aug. 2, 1990 | (JP) | 2-205862 |
| Aug. 2, 1990 | (JP) | 2-205863 |

(51) Int. Cl.[7] ..... B41J 2/165
(52) U.S. Cl. ..... 347/23; 347/29; 347/30
(58) Field of Search ..... 347/23, 14, 19, 347/29, 30, 32, 33, 35; 358/286

(56) References Cited

U.S. PATENT DOCUMENTS

| | | | | |
|---|---|---|---|---|
| 3,925,788 A | | 12/1975 | Kashio | 347/23 |
| 3,925,789 A | | 12/1975 | Kashio | 347/23 |
| 4,306,245 A | | 12/1981 | Kasugayams | 347/33 |
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/7 |
| 4,463,359 A | | 7/1984 | Ayata et al. | 347/56 |
| 4,558,332 A | | 12/1985 | Takahashi | 347/14 |
| 4,558,333 A | | 12/1985 | Sugitami et al. | 346/140 R |
| 4,577,203 A | | 3/1986 | Kawamura | 347/30 |
| 4,692,777 A | | 9/1987 | Hasumi | 347/23 |
| 4,723,129 A | | 2/1988 | Endo et al. | 347/56 |
| 4,740,796 A | | 4/1988 | Endo et al. | 347/56 |
| 4,800,403 A | | 1/1989 | Accattino et al. | 347/30 |
| 4,882,604 A | | 11/1989 | Kato | 399/88 |
| 4,926,196 A | | 5/1990 | Mizoguchi | 347/23 |
| 4,967,204 A | | 10/1990 | Terasawa | 347/23 |
| 4,970,527 A | | 11/1990 | Gatten | 347/23 |
| 4,992,805 A | | 2/1991 | Yoshizawa | 346/134 |
| 5,009,626 A | | 4/1991 | Katz | 446/391 |
| 5,023,728 A | | 6/1991 | Nimura | 358/437 |
| 5,055,861 A | | 10/1991 | Murayama | 347/29 |
| 5,109,233 A | | 4/1992 | Nishikawa | 347/12 |
| 5,136,308 A | | 8/1992 | Saito | 346/139 R |
| 5,138,343 A | | 8/1992 | Aichi | 347/30 |
| 5,140,429 A | | 8/1992 | Ebinuma | 358/296 |
| 5,175,566 A | * | 12/1992 | Ejiri et al. | 347/14 |
| 5,182,650 A | * | 1/1993 | Inoue et al. | 358/296 |
| 5,245,362 A | * | 9/1993 | Iwata et al. | 347/23 |
| 5,262,872 A | | 11/1993 | Yoshimura | 358/296 |
| 5,485,286 A | | 1/1996 | Ejiri | 358/296 |
| 6,123,403 A | | 9/2000 | Makino et al. | 347/5 |
| 6,189,996 B1 | * | 2/2001 | Shimamura et al. | 347/23 |

FOREIGN PATENT DOCUMENTS

| | | |
|---|---|---|
| GB | 2210586 | 6/1989 |
| JP | 54-56847 | 5/1979 |
| JP | 55-69465 | 5/1980 |
| JP | 55-74890 | 6/1980 |

(List continued on next page.)

*Primary Examiner*—Shih-wen Hsieh
(74) *Attorney, Agent, or Firm*—Fitzpatrick, Cella, Harper & Scinto

(57) ABSTRACT

A recording apparatus includes a recording head having an ink ejection outlet for ejecting ink in response to recording data received from a main body of an information processing apparatus. A recover operation is performed on the recording head for restoring ink ejection and for preventing ink ejection failure, in response to a command from the main body of the information processing apparatus.

16 Claims, 13 Drawing Sheets

FOREIGN PATENT DOCUMENTS

| | | |
|---|---|---|
| JP | 55-82660 | 6/1980 |
| JP | 55-95184 | 7/1980 |
| JP | 57-128558 | 8/1982 |
| JP | 59-123670 | 7/1984 |
| JP | 59-138461 | 8/1984 |
| JP | 60-2368 | 1/1985 |
| JP | 60-178260 | 4/1985 |
| JP | 63-224956 | 9/1988 |
| JP | 63-257647 | 10/1988 |
| JP | 1-180352 | 7/1989 |
| JP | 2-175257 | 7/1990 |

* cited by examiner

INK JET RECORDING APPARATUS

This application is a division of application Ser. No. 08/575,462 filed Dec. 20, 1995 now U.S. Pat. No. 6,189,996, allowed, which was a continuation of application Ser. No. 08/032,697 filed Mar. 17, 1993, abandoned, which was a continuation of application Ser. No. 07/654,035 filed Feb. 12, 1991, abandoned.

BACKGROUND OF THE INVENTION

1. Field of the Invention

The present invention relates to an ink jet recording apparatus and more particularly to an information processing apparatus such as a computer, an electronic typewriter a word processor, a facsimile equipment, a copying machine or the like which empoys said ink jet recording apparatus as an output terminal for, for example, images, characters.

2. Related Background Art

Various types of recording systems for recording on a recording medium (referred to "recording paper" or simply to "paper", hereinafter) such as paper, sheets for OHP, etc. have been conventionally proposed on which recording heads operated by varied kinds of recording systems are mounted. The recording heads may be types of wire dot system, system, thermal transfer system, ink jet system, etc,.

Particular attention has been paid to recording heads used in ink jet systems, since this recording system has such advantages that ink is ejected directly to the recording paper, running cost thereof is low and a recording action is quiet.

In recent years, the ink jet recording apparatus, more specifically, the recording head, has been manufactured according to film formation technique or micronization technique in a semiconductor device, and therefore, the production of a more compact and more inexpensive recording head has been realized. Thus, for example, a replaceable recording head integrated with an ink tank has been proposed and the miniaturized and simple structure of an apparatus itself has been enabled, under the circumstances.

The ink jet recording apparatus having the various advantages as mentioned above has been widely utilized as a recording apparatus for varied devices including an electronic typewriter, a word processor, a facsimile equipment, a copying machine, etc,. In this case, the ink jet recording apparatus must have a structure which meets functions and conditions for employment inherent to these devices.

As for the electronic typewriter, the word processor or the like, a compact, light and portable type is liable to be liked, and therefore, the ink jet recording apparatus used for these devices must have been compact and simple in this point.

In the ink jet recording apparatus of such type, a recording operation is performed in such a way that ink is supplied to a recording head, the ink is ejected from an ejection outlet provided on the face of the recording head opposed to a recording medium to form flying ink droplets and the ink droplet is applied to the recording medium. In the ink recording apparatus, generally, during the recording operation or when the recording head is not used but is kept standing or the like, ink scum, paper powder or dust may possibly adhere to an ink ejection outlet or air bubbles may enter the interior of the ink ejection outlet, which causes an ink discharge failure. The causes of the ink discharge failure have been removed by using recovery methods such as the ink being sucked out of the ink ejection outlet, the ink being discharged from the ejection outlet by pressing an ink supply system, or the ink being removed by performing a prescribed ink discharging operation (called "preliminary discharge" or "idle discharge"), in place of these forced discharging operations, or along with them.

The above described ink jet recording apparatus has operated in response to the automatic operation of the above recover device or a manual operation thereof by an operator when the power of the recording apparatus is turned on, when recording failure is generated during the recording, after a long recording interruption or after a prescribed amount of recording operation.

However, in such an ink jet recording apparatus that the recover device is designed to operate when the power is turned on or during the Interruption of the recording operation, irrespective of whether the recording is performed thereafter or not, and therefore, the ink is unavoidably wastefully thrown away according to a discharge stabilizing process (recover process). Especially, in recent years, the use of recording heads of a type that the ink is discharged by making use of thermal energy enables the miniaturization of the ink jet recording apparatus to be promoted. Some ink jet recording apparatuses, as one example of use, may be integrally built in a word processor, an electronic typewriter and other information processing apparatus. In such a recording apparatus, since the power is often turned on for example, only for editing sentences without performing the recording, increase in the amount of ink consumed in the ink jet recording apparatus causes a great problem.

In case where the recover process is performed in response to a manual operation according to the decision of the operator, the recording medium on which the recording failure arises is inevitably wasteful because the recover device operates after the failure in recording is detected.

Further, even if the prescribed number of similar recover operations are automatically carried out when a predetermined stand-by period elapses, the discharge failure including non-discharge may not be completely recovered only depending on the prescribed number of recover operations, in case where, for example, the recording head is left as long as more than one month, because prescribed time and the number of recover operations are constant. For instance, in case the recording head has been left as long as 26 hours, the prescribed number of recover operations are conducted, which may, on the contrary, lead to the excessive increase of the recover operations and to the wasteful consumption of the ink due to the suction of ink or the like.

In case the recover operation is conducted when the power is turned on and then, the recording head is left with the power kept turned on without performing the recording operation, there is a possibility that the recover operation is not carried out during an ordinary recording, resulting in the discharge failure including non-discharge. In the control for performing the recover operation every time the power is turned on without taking time from the recover process of the preceding time into consideration, the recover operation is performed every power on, in case the power is repeatedly turned on and off at intervals of short time, which inconveniently results in an unnecessary recovery operation.

SUMMARY OF THE INVENTION

A primary object of the present invention is to provide an ink jet recording apparatus in which a recording failure can be prevented without consuming ink wastefully.

Another object of the present invention is to provide an ink jet recording apparatus in which a constantly excellent recording is enabled by making a recovery operation for discharge failure in an adequate manner and at a proper timing.

A still another object of the present invention is to provide an ink jet recording apparatus in which a recovery operation is started for recovering and preventing the generation of a discharge failure in an ink discharge outlet for discharging ink based on recording data supplied from a main body of an information processing apparatus which is the supply source of the recording data, in response to a command from the main body of the information processing apparatus.

A further object of the present invention is to provide an information processing apparatus in which recording data and a command starting a recovery operation for recovering a discharge failure in an ink discharge outlet and preventing the generation of the discharge failure are supplied to an ink jet recording apparatus having the ink discharge outlet for discharging ink based on the recording data.

According to the present invention, the recover process of the ink jet recording apparatus is controlled by the main body side of an information processing apparatus and during the recording operation by using the ink jet recording apparatus, the recover operation is performed only when it is required, and therefore, the useless consumption of ink can be avoided. The employment of a timer function which is usually provided in the information processing apparatus in order to control the start timing of the recover process makes it unnecessary to provide a timer or a buck-up power source in the ink jet recording apparatus side, so that the increase of cost for constructing or maintaining the ink jet apparatus can be suppressed.

Since the form or the number of a series of recover operations such as the suction or ink, preliminary discharge which are carried out upon turning a power on or starting recording is variable in accordance with, for example, time elapsing from the recover operation of the last time, an essential recover operation can be performed more accurately and adequately,

DETAILED DESCRIPTION OF THE PREFERRED EMBODIMENTS

One embodiment of the present invention will be described in detail with reference to the accompanied drawings.

Figure 1A:
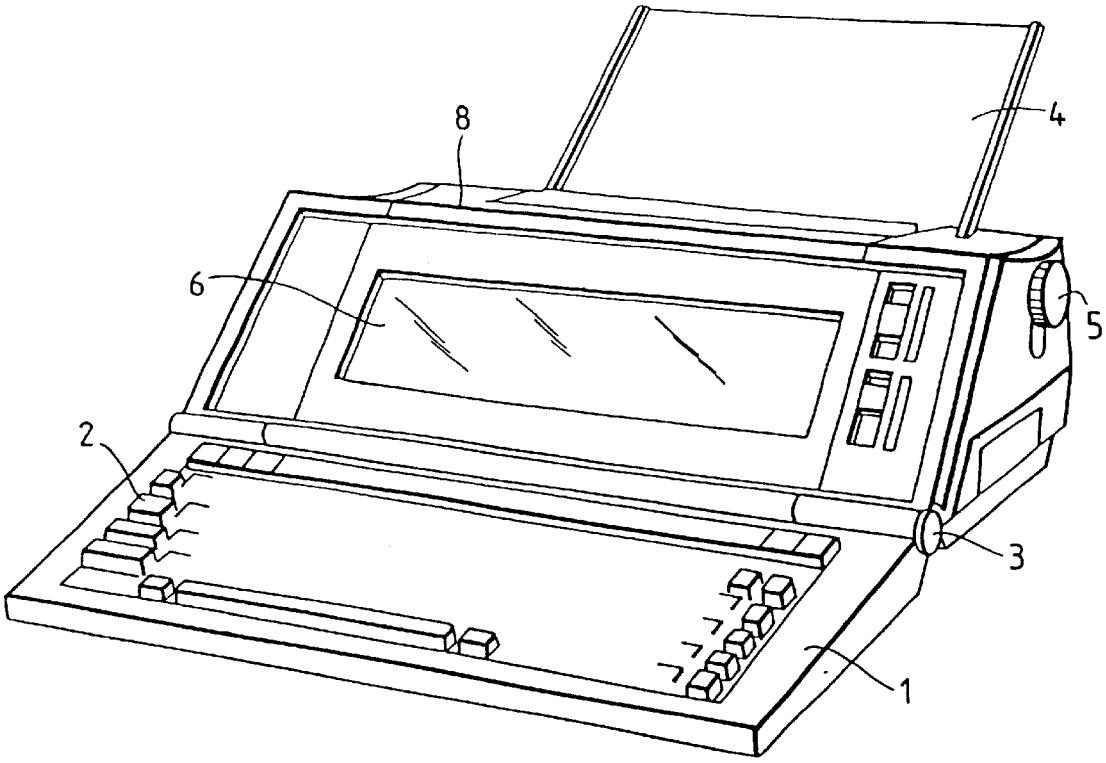
FIG. 1A and FIG. 1B are perspective views of an appearance of a sentence processing apparatus as an information processing apparatus according to one embodiment of the present invention.
Figure 1B:
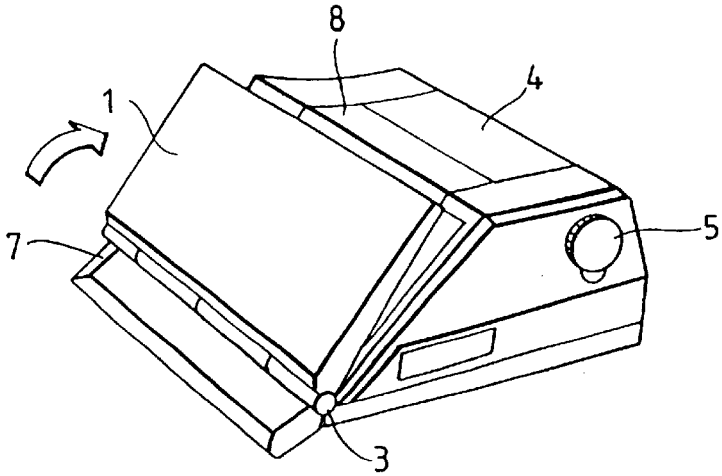

FIG. 1A and FIG. 1B are perspective views showing the appearance of a sentence processing apparatus such as a word processor, an electronic typewriter, etc., to which the present invention is applied.

On a keyboard 1, key groups 2 such as keys, control keys for inputting characters, numeric characters or the like are arranged. The keyboard is collapsible around a hinge 3 as shown in FIG. 1B when it is not used. A paper feed tray 4 serves to feed a sheet like recording medium to a printer part in the apparatus. The paper feed tray 4 is also housed in the apparatus when it is not used by covering the printer part as shown in FIG. 1B. A feed knob 5 serves to manually set or eject the recording medium. A display device 6 displays an inputted sentence or the like. A handle 7 is used for carrying the apparatus according to the present embodiment.

A cover 8 of the sentence processing apparatus serves as a window provided on the upper part of the apparatus which is adjacent to the display device 6. A housed ink jet printer or recording medium can be seen through it, as described later.

Figure 2:
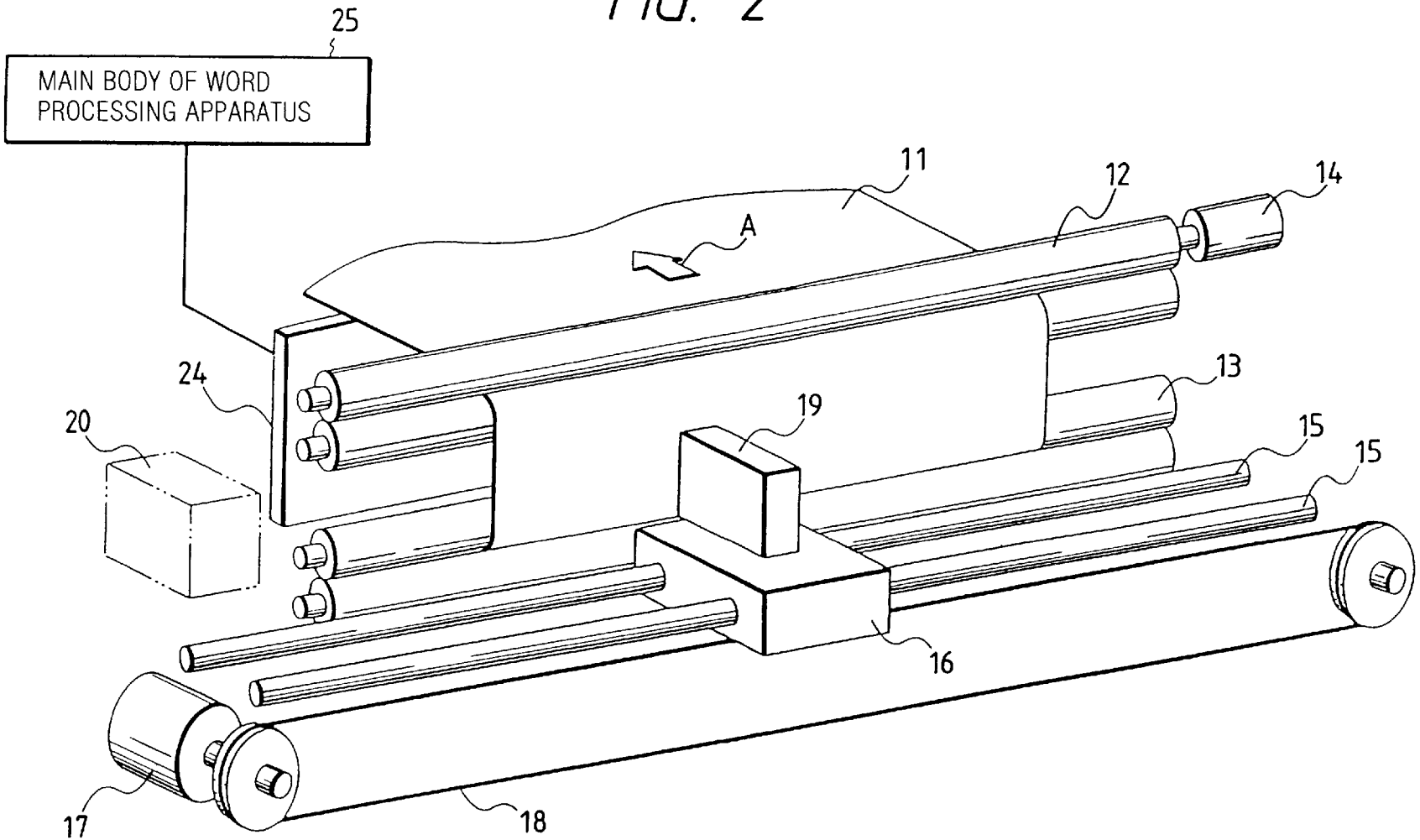
FIG. 2 is a perspective view showing the structural example of an ink jet recording apparatus as a printer part.

FIG. 2 is a typical perspective view showing the main parts of a printer part according to the present embodiment.

In FIG. 2, a recording medium 11 is supported by conveying rollers 12, 13 disposed above and below a recording region and conveyed toward the direction shown by an arrow A by the conveying roller 12 driven by a sheet feed motor 14. At the front side of the conveying rollers 12, 13 are disposed guide shafts 15 on which a carriage 16 is driven in reciprocating motion through a wire 18 by the output of a carriage motor 17.

On the carriage 16 is mounted a recording head 19 for ejecting ink by making use of thermal energy. The recording head 19 has a recording part provided on the front face thereof, which is opposite and spaced apart from the recording medium 11 and on which face, a plurality of ink ejection outlets are arranged to form a longitudinal line. At the end of the guide shafts, a recover mechanism 20 is provided at a position opposite to the front face of the recording head 19 mounted on the carriage 16.

Figure 3:
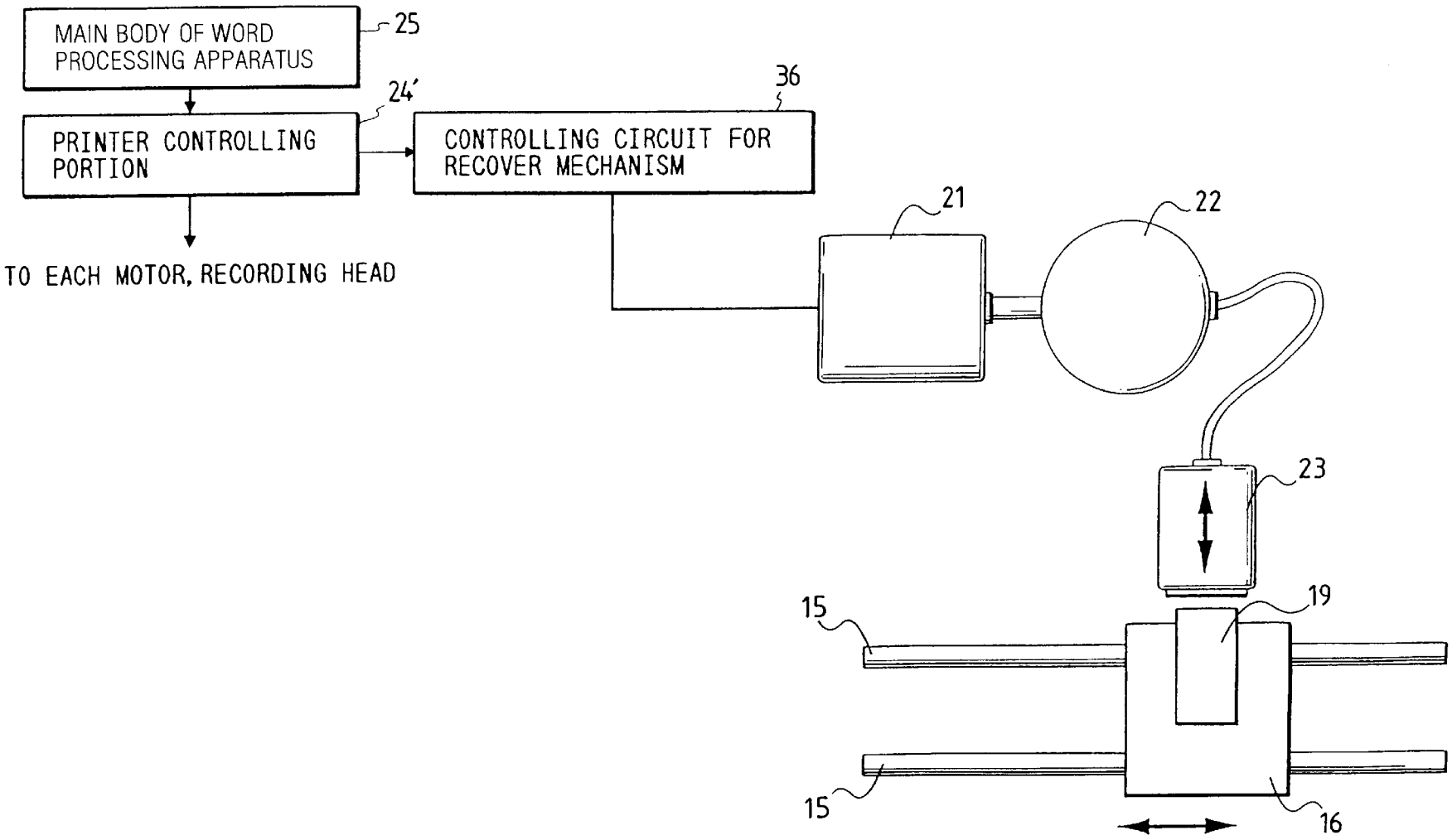
FIG. 3 is a typical view showing the structural example of a recover mechanism.

FIG. 3 is a typical view showing a suction recover device as an example of the recover mechanism 20. A pump 22 driven by a pump driving motor 21 communicates with a cap 23 which is opposed to the front face of the recording head 19, for example, at a home position of the recording head 19 and disposed so as to be attachable thereto or detachable therefrom. The pump 22 performs an operation for sucking a prescribed amount of ink from the ink ejection outlets in response to a signal sent from a printer control portion 24' through a recover mechanism control circuit 36.

Returning to FIG. 2, the printer control portion 24' including the control circuit (CPU) of the recording apparatus and a ROM for storing program or other fixed data or a RAM for operating them which are provided along with the CPU is formed on a control substrate 24. The printer control portion 24' receives a signal from the main body of the sentence processing apparatus 25 and controls the driving of various motors and the recording head based thereon.

Figure 4:
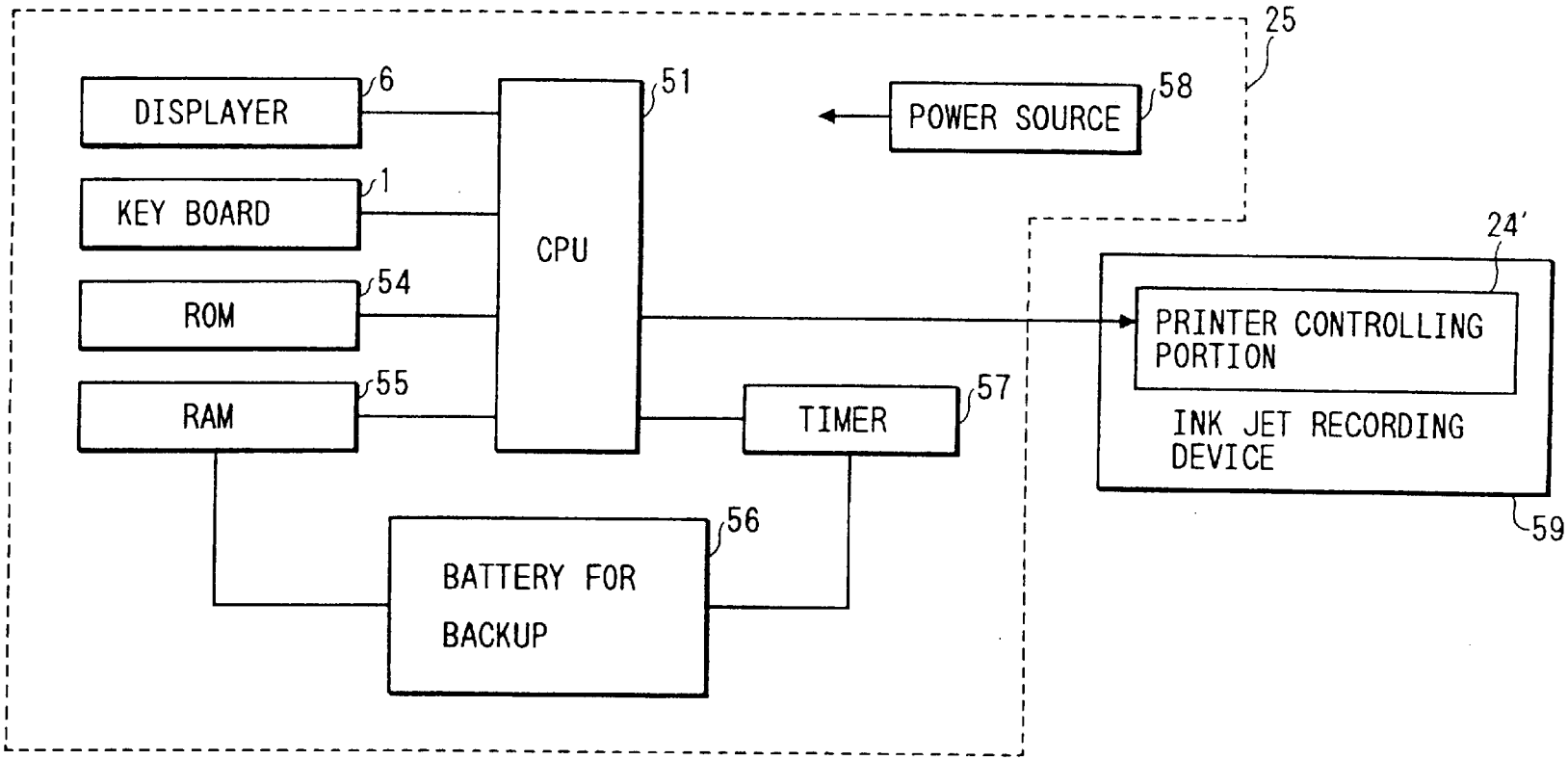
FIG. 4 is a block diagram showing the structural example of a control system for the information processing apparatus according to this embodiment.

FIG. 4 is a block diagram showing a structural example of a control system of the sentence processing apparatus of this embodiment.

A central processing unit (CPU) 51 processes characters or the like input from the keyboard part 1, displays them on the display device 6 or store them in a read/write memory device (RAM) 55. A read only memory device (ROM) 54 stores program or fixed data or the like corresponding to the processing procedure executed by the CPU 51. A timer 57 serves to control time. A battery 56 for back-up continues to operate the timer 57 and the RAM 55 even when a power source 68 of the sentence processing apparatus is disconnected. An ink jet recording apparatus 59 is described with reference to FIGS. 2 and 3. The CPU 51 in the main body of the sentence processing apparatus 25 outputs a recording command signal, recording information or other control signals to control a recording operation or a recover process by the printer control portion mounted on the control substrate 24.

Figure 5:
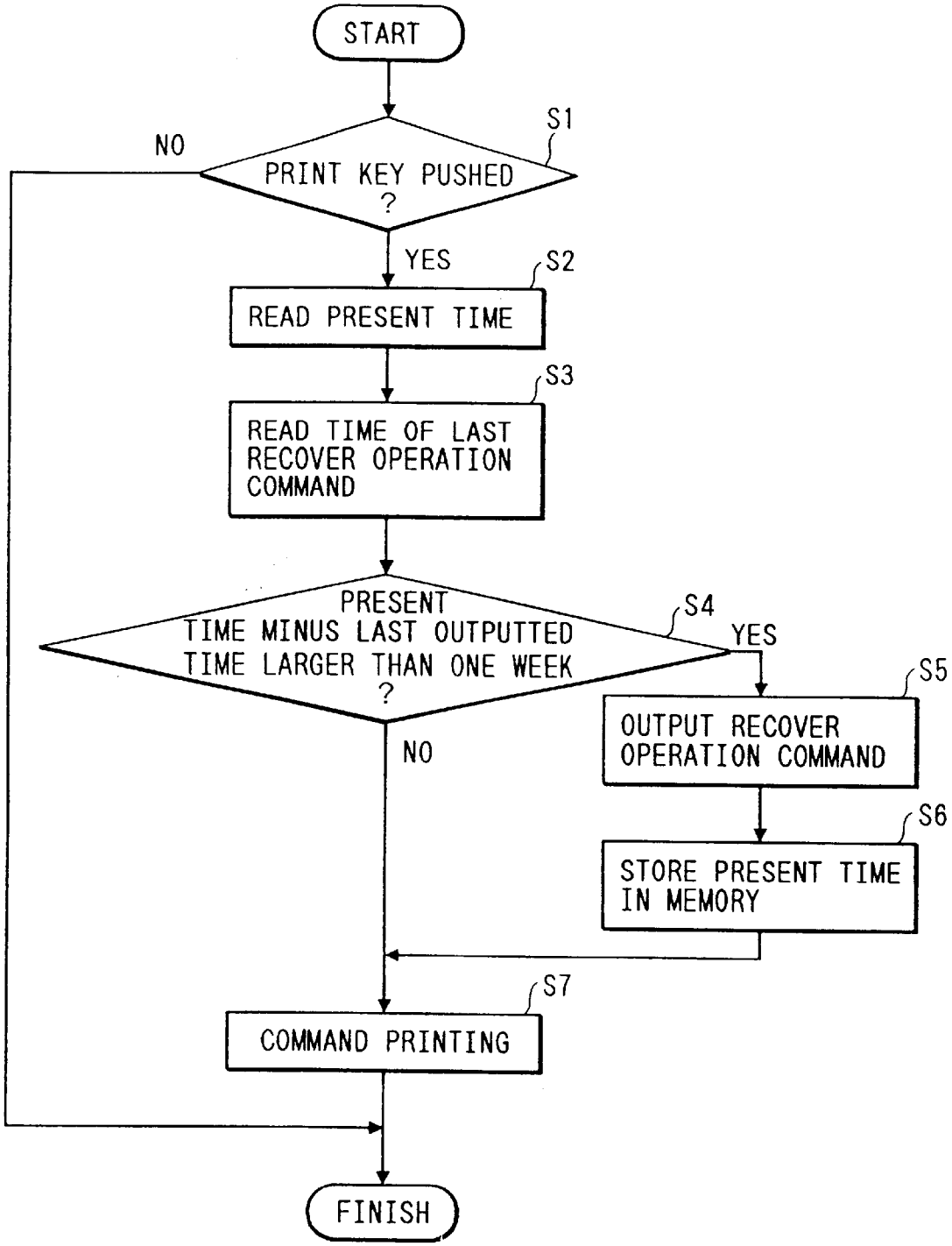
FIG. 5 is a flow chart showing one example of a control procedure of the above.

FIG. 5 is a flow chart showing one example of a control procedure of the present embodiment. This control procedure is designed so that In case a printing (recording) is to be done by the ink jet recording apparatus, when the present time for printing passes more than one week from the last time when a command for recover operation is outputted, a command for recover operation is outputted before the output of a command for printing.

First, in a step S1, whether an operator who intends to start recording by the ink jet recording apparatus pushes a print command key or not is judged. If he does not push the key, this procedure is finished, and then it proceeds to other process, for example, a sentence edition or the like. On the other hand, if the operation of the print command key is detected, the present-time is read by the use of the timer 57 (FIG. 4). Then the time when the command for recover operation was last output is read from the RAM 55 in a step S3. Next, in a step S4, the time read in the step S2 is compared with the time read in the step S3. If more than one week passes from the time read in the step S3 to the time read in the step S2, the procedure proceeds to a step S5 and a command for recover operation is output to the ink jet recording apparatus. Then, the printer control portion 24' starts the above described recover operation in response thereto. In a step S6, a time storage region in the RAM 56 is rewritten by regarding the present time as the time when the command for recover operation is outputted. Thereafter, the procedure proceeds to a step S7, and printing information designated by the operator is transferred to the ink jet recording apparatus to be printed. In case it is judged that more than one week does not elapse from the last time of command for recovery operation, the procedure immediately proceeds to the step S7.

The recover process is not limited to the forced ejection or discharge of ink by sucking out the ink but also may be applicable to such a forced ejection of ink that an ink supply system leading to the recording head 19 is pressed to forcedly eject the ink. Further, the recover process may be performed, through, in place of these forced ejections of ink, preliminary ejection of ink or along with them.

Although in the present embodiment, in case the recover operation has not been performed for more than one week, on starting a printing process, the above recover process is conducted, it will be noted that such a period may be suitably determined depending on the performance of the recording head. Such a period may be variable depending on environmental conditions such as ambient temperature. In addition, in case a plurality of types of recover processes are combined and used, the period may be varied in accordance with the types thereof and the combination of the recover processes may be changed.

Further, although, in the above embodiment, the ink jet recording apparatus is integrally built in the information processing apparatus in the form of a sentence processing apparatus, a computer, facsimile equipment or the like may be applicable as examples of the information processing apparatus and the ink jet recording apparatus may be formed separately from the main body of the information processing apparatus.

Still further, the ink ejection recover processes are not wholly controlled by the main body side of the information processing apparatus, but may be independently performed by the ink jet recording apparatus side through an automatic or manual operation if required during a recording operation.

As explained in the foregoing pages, since the recover process of the ink jet recording apparatus is controlled by the main body side of the information processing apparatus and the recover process is conducted only when it is required upon a recording operation using the ink jet recording apparatus, the wasteful use of the ink can be avoided. Also, since the timer function which is usually provided in the information processing apparatus in order to control the starting timing of the recover process is utilized, the provision of a timer or a power source for back-up is not necessary at the ink jet recording apparatus side, and therefore, cost for constructing or maintaining the ink jet recording apparatus can be suppressed.

Another embodiment of the present invention will be described in the following by referring to the accompanying drawings.

Figure 6:
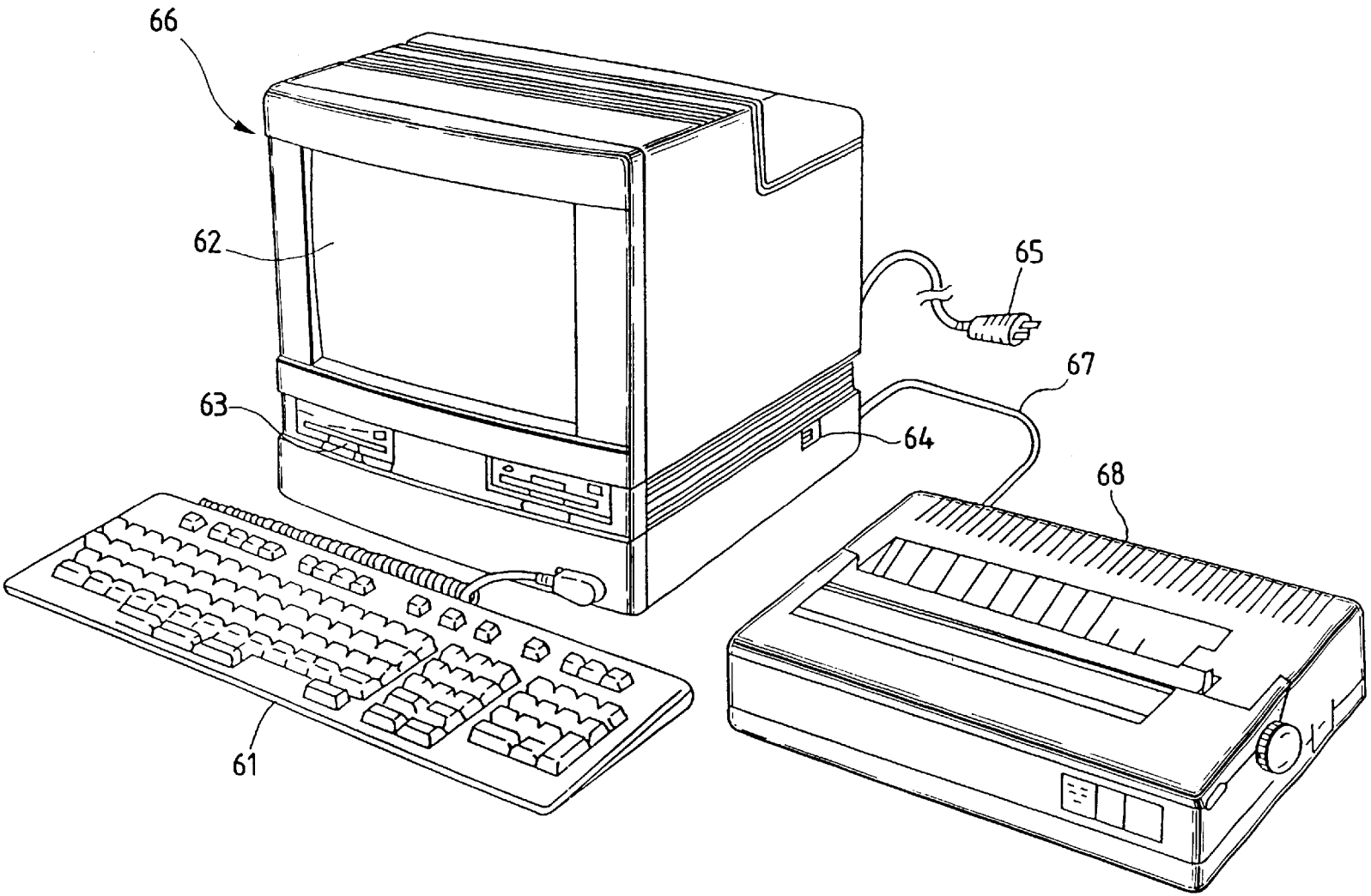
FIG. 6 is a perspective view showing another embodiment of a document processing apparatus provided with the ink jet recording apparatus of the present invention.

FIG. 6 is a perspective view showing another embodiment of a document processing apparatus provided with the ink jet recording apparatus according to the present invention.

This document processing apparatus is provided with a main body 66 comprising a keyboard 61 which is an input part for data such as document information and control command, a display part 62 on which the document information is displayed and a drive unit 63 for driving a floppy disk. This main body 66 is connected to an ink jet recording apparatus 68 through an interface cable 67. The main body 66 is connected to a power source (not shown) by a power plug 65 and started by turning the power switch 64 of the main body 66.

The ink jet recording apparatus 68 will be explained in more detail with reference to a perspective view of main parts shown in FIG. 7.

In the ink jet recording apparatus 68, an ink jet recording head 70 and an ink jet head cartridge 69 integrated with an ink tank (not shown) are mounted on a carriage 71. The carriage 71 is connected to one part of a driving belt 72 for transmitting the driving force of a driving motor 73 and slidingly attached to two guide shafts 74A, 74B which are disposed in parallel to each other. The ink jet recording head 70 moves in a reciprocating motion by the driving force of the driving motor 73 along the entire width of recording paper (recording medium) fed on a platen 75 from a recording medium feeder (not shown) so as to face the surface having ink ejection outlets of the ink recording head 70 and conducts a recording on the recording paper.

The above-mentioned ink jet recording head 70 has ink ejection outlets facing the recording surface of the recording paper and electrothermal transducers employed for ejecting ink from the ejection outlets. To the ink ejection outlets is supplied ink from an ink tank integrated in the ink jet head cartridge 69.

The ink jet recording apparatus 68 is provided with a head recover device 76 having a cap part 76A for capping the surface having the ink ejection outlets of the head. This recover device 76 is driven by the driving force of a motor 78 through a transmission mechanism 79 facing the surface having the ink ejection outlets of the ink jet recording head 70 at a position (left end of a guide shaft 74A in FIG. 7, called "recover position", hereinafter) where the ink jet recording head 70 is moved during the head recover operation, outside the range of the reciprocating motion of the ink jet recording head 70 during the recording operation. This head recover device 76 achieves the suction of ink by means of a proper sucking means or the forced feed of ink by means of a proper pressing means disposed in an ink supply path leading to the ink jet recording head 70, in connection with capping of the surface having the ejection outlets of the ink jet recording head 70 by the cap part 76A, during the head recover operation, to forcedly eject the ink from the ink ejection outlets, whereby the ejection and recover operation such as thicker ink in an ink passage communicating with the ejection outlets being removed is performed.

On the side face of the head recover device 76, a blade 77 formed of silicone rubber as a wiping member is held in the form of a cantilever by a blade holding member 77A. The blade 77 is operated by the motor 78 and the transmission mechanism 79, like the head recover device 76, and can slidingly and frictionally engage with the surface for the ejection outlets of the ink jet recording head 70. Thus, after the recover operation for ejection failure by using the head recover device 76, the blade 77 is caused to protrude in the moving path of the ink jet recording head 70 and dew drops, wetting or dusts, etc., sticking to the surface for the ejection outlets of the ink jet recording head 70 are wiped out, along with the movement of the ink jet recording head 70.

The above-described ink jet recording apparatus 68 receives data such as document information, control command, etc., inputted from the keyboard 61 through the main body 66 and the interface cable 67 and performs a series of recording operations of the document information and the above head recover operation, based on the received data.

Figure 8:
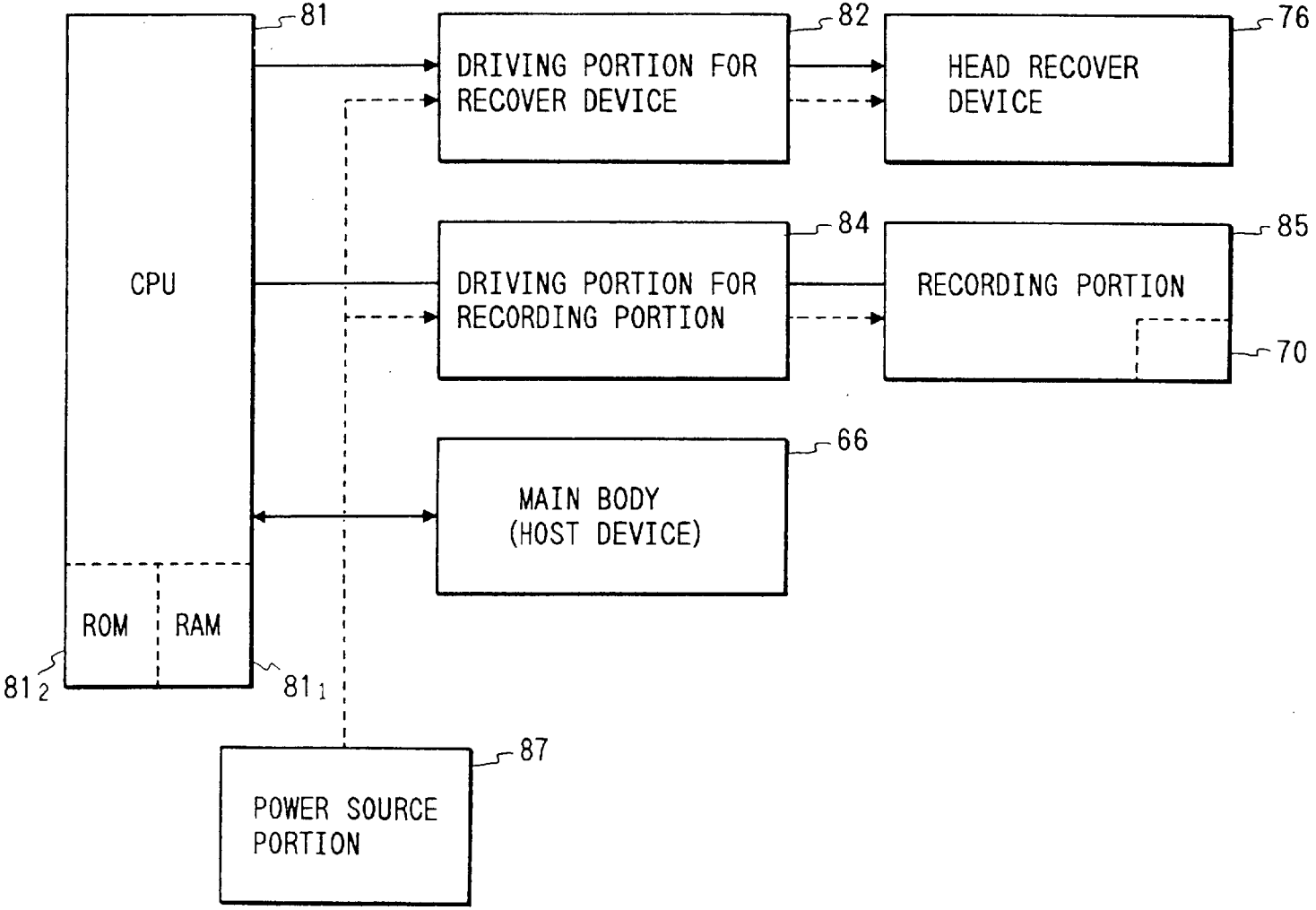
FIG. 8 is a block diagram showing other example of a printing control system of the ink jet recording apparatus of the invention.

A printing control system of the ink jet recording apparatus 68 will be explained below by referring to a block diagram in FIG. 8. A CPU 81 comprises a one-chip element consisting of a RAM$\mathbf{81}_1$ used as a buffer memory or a below mentioned power-on flag and a ROM$\mathbf{81}_2$ storing a program for executing a below mentioned operation or the like. The CPU 81 transfers various kinds of commands sent from the main body 66 to a driving portion 82 for a recover device or a driving portion 84 for a recording part and operates as a recover control means. The driving portion 82 for the recover device supplies electric power from a power source part 87 to the head recover device 76 in response to a command from the main body 66 which is transferred by the CPU 81 to drive the head recover device 76.

Figure 7:
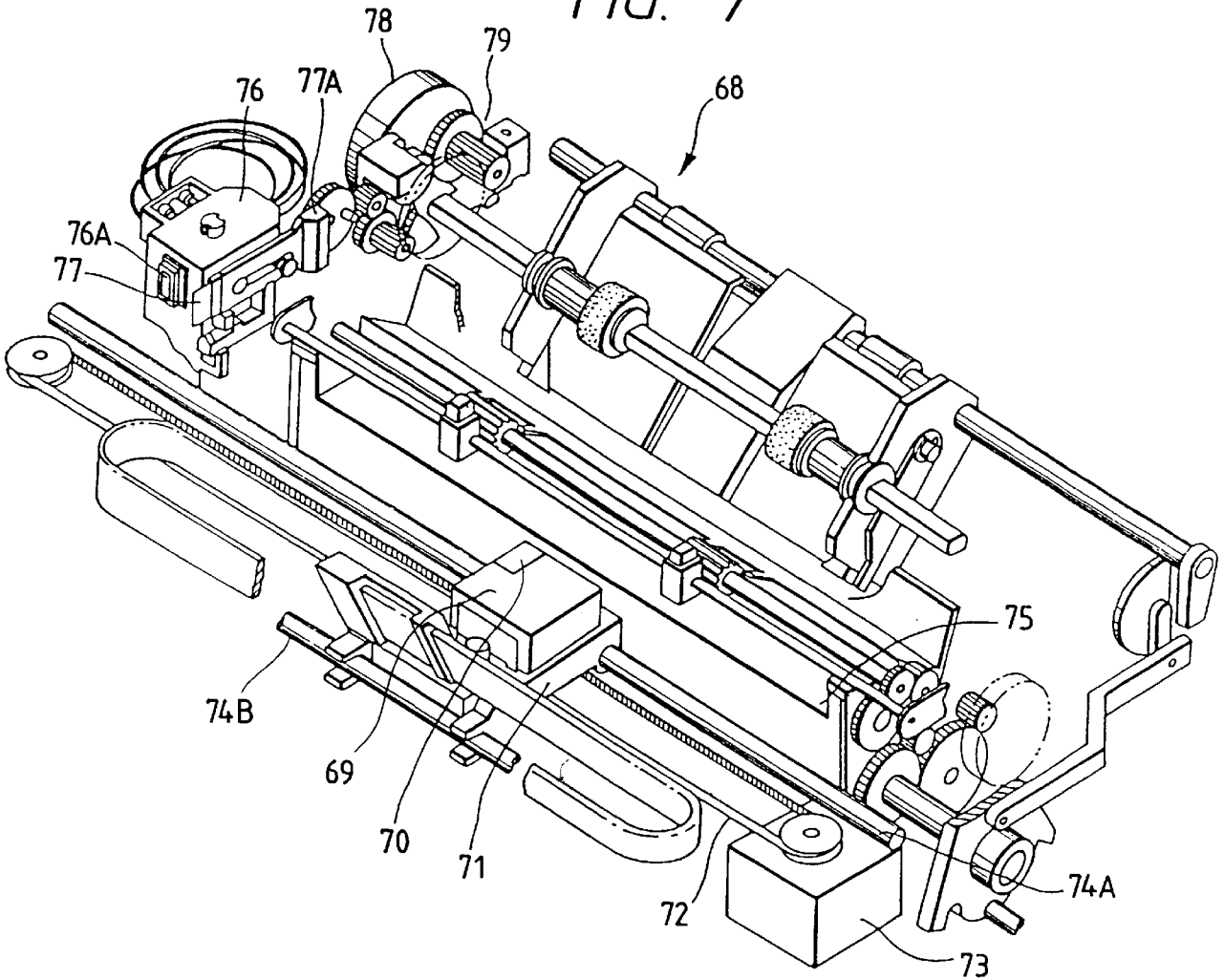
FIG. 7 is a perspective view showing the structure of main parts of the ink jet recording apparatus of the above embodiment.

A recording part 85 comprises the ink jet recording head 70, the carriage 71, the driving belt 72, the driving motor 73, the guide shafts 74A, 74B, the platen 76, the motor 78, and the transmission mechanism 79 shown in FIG. 7. The electric power from the power source part 87 is supplied to the recording part by the driving portion 84 for the recording part to drive the recording part in accordance with an instruction of the main body 66 which is transferred from the CPU 81, The main (host) body 66 is a device for transmitting instruction such as recording command or recording information to the CPU 81 and its power source is independent. The main body may be constructed in a personal computer or the like as well as in the document processing apparatus (word processor) as illustrated in FIG. 6. The power source part 87 supplies the electric power to the driving portion 82 for the recover device and the driving portion 84 for the recording part.

Figure 9:
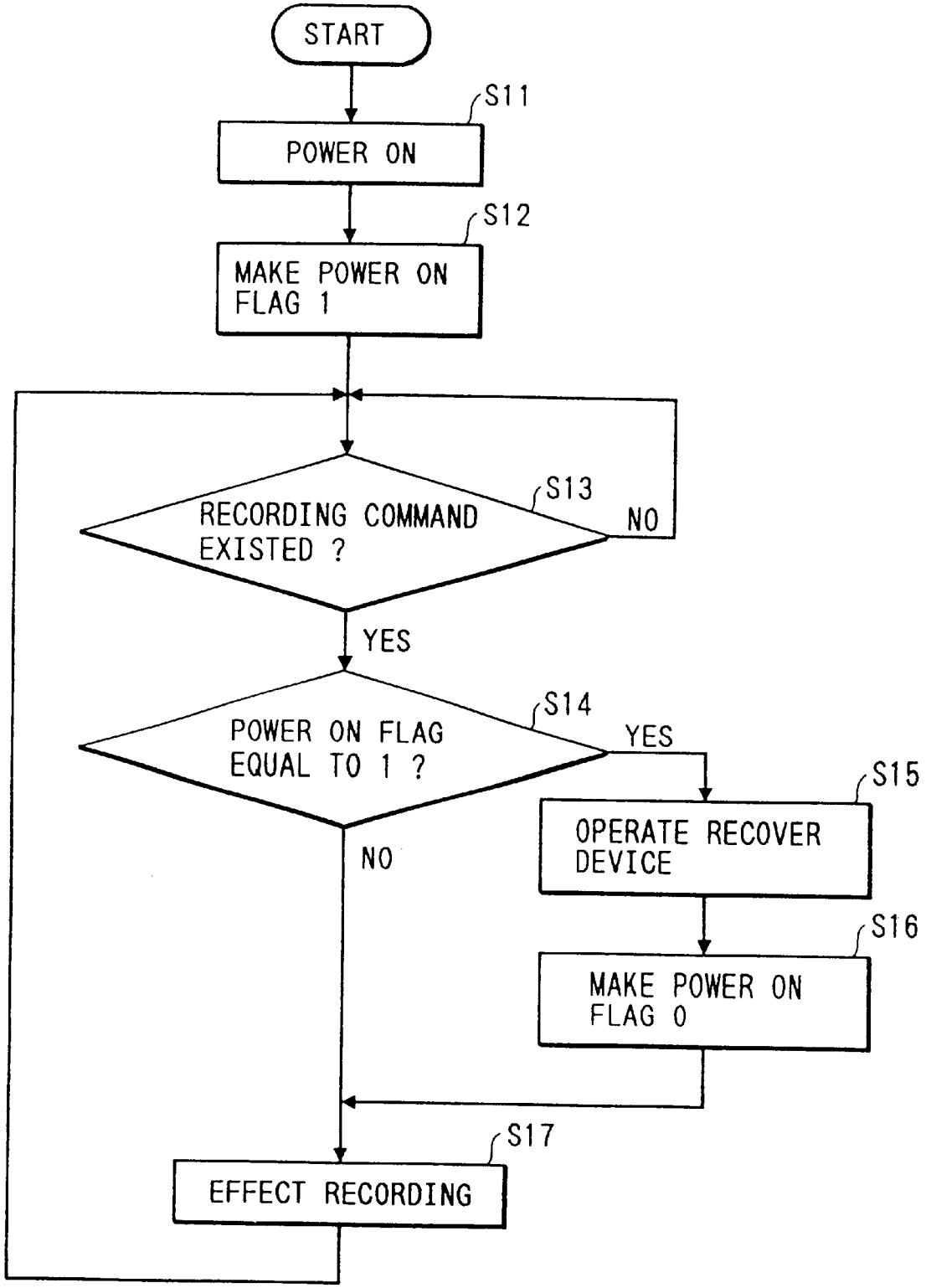
FIG. 9 is a flow chart showing the operation of the above embodiment.

Referring to a flow chart shown in FIG. 9, the operation of the embodiment shown in FIGS. 6 to 8 will be explained in the following.

In a step S11, a power is turned on. When the electric power is supplied from the power source part 87 to the CPU 81, the driving portion 82 for the recover device and the driving portion 84 for the recording part, the CPU 81 begins to perform the program stored in the ROM $\mathbf{81}_2$. In a step S12, the CPU 81 sets a power-on flag to which a prescribed address in the RAM $\mathbf{81}_1$ is assigned to "1". In a step S13, it waits for a recording command from the main body 66. In the step S13, if there is a recording command, that is, the recording command is sent from the main body 66, whether said power-on flag is set at "1" or not is checked in a step S14. If the power-on flag is set at "1" in the step S14, the head recover device 76 is operated by the driving portion 82 for the recover device to keep the ejection outlets (not shown) of the recording head 70 in a normal state in a step S15. After the power on flag is set to "0" in a step S16, a recording is effected in a step S17 as instructed from the host device 66.

Meanwhile, if the power-on flag is not set at "1" in the step S14 (if it is set at "0"), the recording is effected in the step S17 without operating the head recover device 76. After the step S17 is performed, the procedure returns to the step S13 to wait for a recording command from the main body 66. The operations mentioned above are repeated.

The power source part 87 may be applicable to either side of the ink jet recording apparatus and the main body 66, because the recover operation can be enabled by turning tho power source on.

As understood from the foregoing explanation, since a recover means is operated when a first recording command is sent from the host device after the power is turned on, according to the present invention, the useless consumption of ink, when turning the power on for the purpose other than recording, can be eliminated and the generation of recording failure during recording can be prevented.

The present invention is particularly usable for such type of recording head as having thermal energy generating means which generate thermal energy utilized for ejecting or discharging ink, since ink scum easily adheres to the periphery of an ink ejection outlet or air stays in the interior of the ink ejection outlet because of the thermal energy, as a result, the ink ejection outlet is readily clogged.

A still another embodiment of the present invention will be described in detail by referring to the accompanied drawings.

Figure 10:
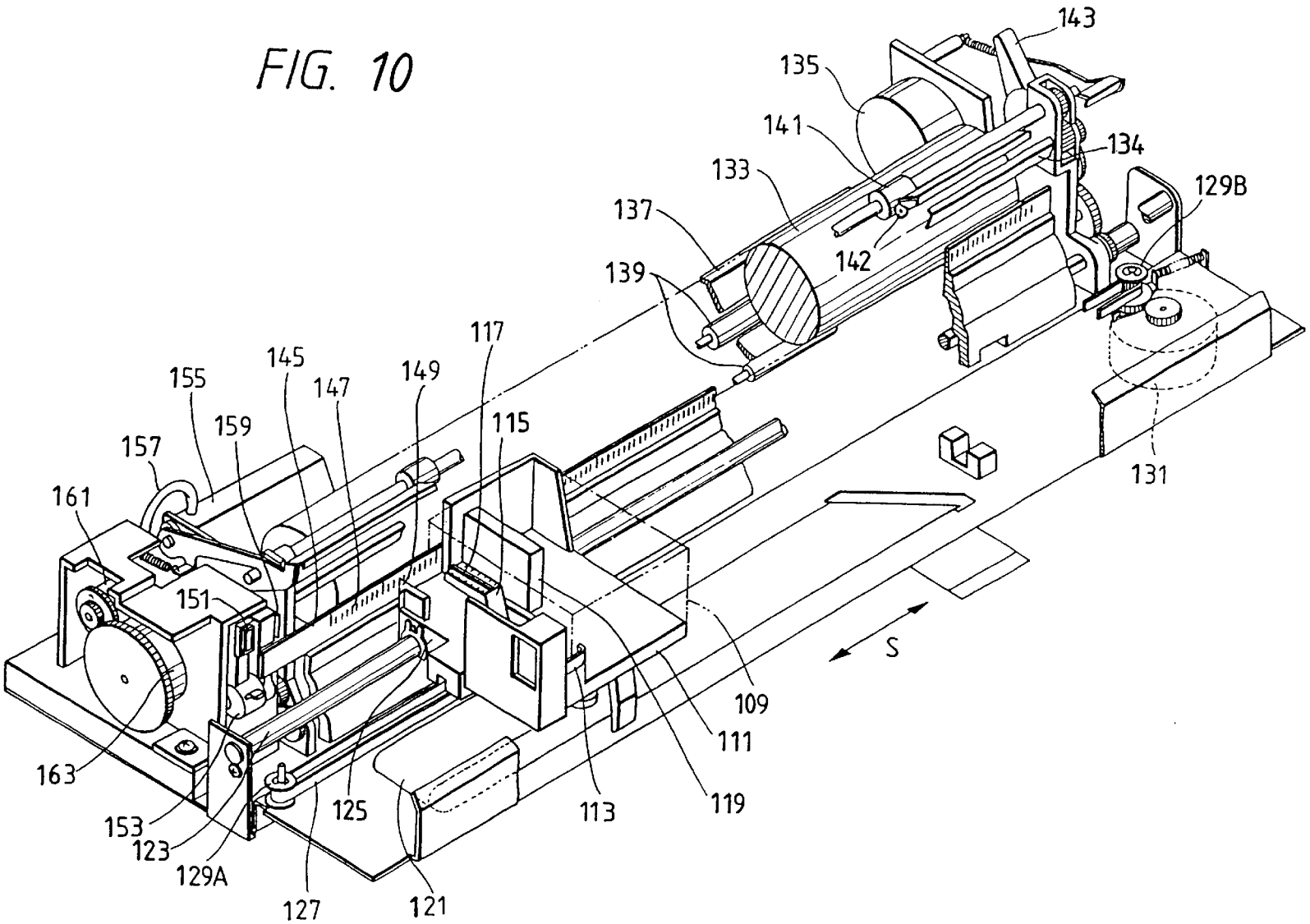
FIG. 10 is a perspective view showing a still another embodiment of a printer applicable to the present invention.

FIG. 10 is a typical perspective view showing main parts of a printer part according to the present embodiment.

In FIG. 10, a head cartridge 109 has an ink jet recording head. The head cartridge 109 is mounted on a carriage 111 for scanning in the direction S in FIG. 10. A hook 113 serves to attach the head cartridge to the carriage 111. A lever 116 is used for operating the hook 113. On this lever 115, a marker 117 is disposed for indicating a scale provided on a below-mentioned cover so as to read a printing position or setting position by the recording head of the head cartridge. A support plate 119 supports an electric connecting part to the head cartridge 109. A flexible cable 121 connects the electric connecting part to a control part for a main body.

A guide shaft 123 guides the carriage 111 toward the direction S and is inserted into the bearing 125 of the carriage 111. A timing belt 127 on which the carriage 111 is fixed transmits power for moving the carriage 111 toward the direction S and is extended to pulleys 129A, 129B provided at both sides of the apparatus. To one pulley 129B, is transmitted driving force from a carriage motor 131 through a transmission mechanism such as a gear. A conveying roller 133 restricts a surface to be recorded of a recording medium (recording paper) such as paper, conveys the recording medium during recording or the like, and is driven by a conveying motor 135. A paper pan 137 guides the recording medium to a recording position from a paper feed tray 4 side. A feed roller 139 is disposed midway along a recording medium feed path, presses the recording medium toward the conveying roller 133 and conveys it. A platen 134 faces the ink ejection outlets of the head cartridge 109 and restricts the surface to be recorded of the recording medium. A paper ejecting roller 141 is disposed at the downstream side from a recording position in the direction for conveying the recording medium and ejects the recording medium to a paper ejection port (not shown). A spur wheel 142 is disposed correspondingly to the paper ejecting roller 141 and presses the roller 141 through the recording medium so that conveying force for the recording medium is produced by the paper ejecting roller 141. A release lever 143 serves to release the energizing forces of the feed roller 139, the presser plate 145 and the spur wheel 142, for example, when the recording medium is set. The presser plate 145 suppresses the floating of the recording medium or the like in the vicinity of the recording position and maintains the tight contact state of the recording medium and the conveying roller 133. In the present embodiment, such an ink jet recording head is adopted that a recording operation is performed through the ejection of ink. The distance between the surface of the recording head on which ink ejection outlets are formed and the surface to be recorded of the recording medium is, therefore, exceedingly small, and the space must be strictly controlled for avoiding the contact of the recording medium and the surface having the ejection outlets, so that the provision of the presser plate 145 is effective. Scale 147 is provided on the presser plate 145. A marker 149 is provided on the carriage 111 correspondingly to this scale. The printing position or the setting position can be also read thereby.

A cap 151 formed of elastic material such as rubber faces at a home position, the surface, on which the ink ejection outlets are formed, of the recording medium and is supported so that it can abut against and disengage from the recording head. This cap 151 is used for protecting the recording head when it is not made use of or for an ejection and recover process of the recording head according to the present invention. The ejection and recover process described herein represents such processes that the ink is ejected from all the ink ejection outlets by opposing the cap 151 to the surface having the ink ejection outlets, and driving energy generating means provided in the ink ejection outlets and generating energy employed for ejecting the ink, whereby factors for ejection failure such as bubbles, dust, thicker ink which has increased viscosity, and therefore, becomes inadequate for recording or the like are removed (preliminary discharge or preliminary ejection), or factors for ejection failure are removed by forcedly ejecting the ink from the ink ejection outlets, while the surface on which the ink ejection outlets are formed is covered with the cap 151, unlike the above preliminary ejection.

A pump 153 generates auction force required for the above forced ejection of ink (suction) and is a pump used for sucking (idle suction) the ink retained in the cap 151 when the ejection and recover process through the forced ejection or through the preliminary ejection is done. A waste ink tank 155 stores waste ink which is sucked by the pump 153. A tube 157 communicates with the pump 163 and the waste tank 155. A blade 159 for wiping the surface having the ink ejection outlets of the recording head is supported to be movable to a position where it protrudes to the recording head side and wipes the surface during the movement of the head and to a retreat position where it does not engage with the surface having the ink ejection outlets. A cam device 163 receives transmission of power from a motor 161 to drive the pump 153 and move the cap 151 or the blade 159, respectively.

The ejection and recover operation mentioned below points to a train of operations including sucking, cap opening, preliminary ejection, idle suction and wiping and a once ejection and recover operation points to one cycle of a train of these operations.

Figure 11:
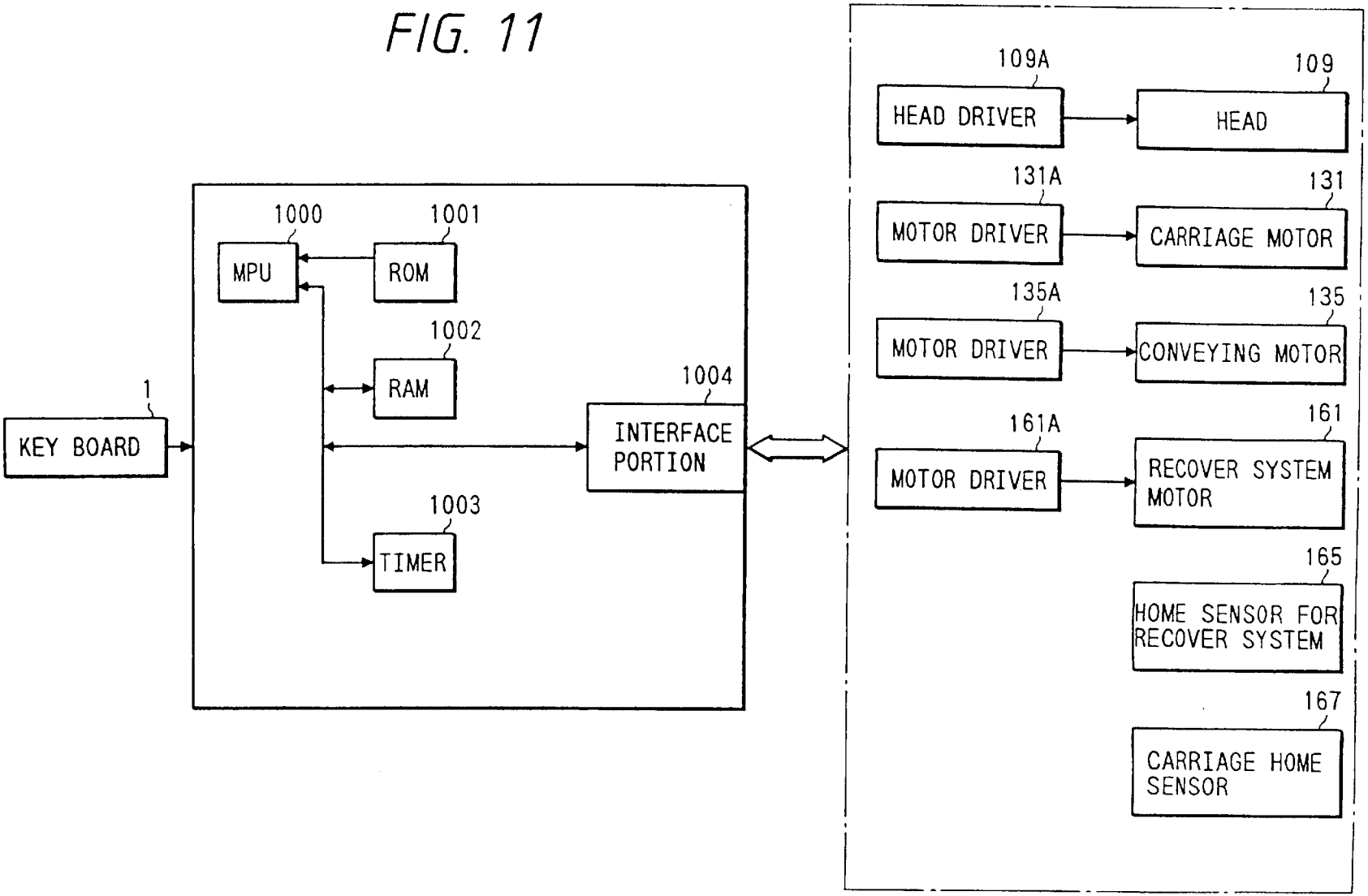
FIG. 11 is a block diagram showing a control structure of the printer shown in FIG. 10 and FIG. 12 and FIG. 13 respectively show flow charts showing procedures for processing a discharge recover operation shown in the Table.

FIG. 11 is a block diagram showing the structure of a control part for performing a control operation described later with reference to FIGS. 12 and 13.

The cap position or moving position of the carriage 111 can be recognized based on the detection of a home sensor 165 for a recover system or a carriage home sensor 167. The movement of the carriage to an instructed position or the setting and input of the instructed position are effected by using a space key or a prescribed key provided on the keyboard 1. The ejection and recover operation according to the present embodiment is achieved through the suction of ink or the opening and closing of the cap by operating the recover motor 161 through a motor driver 161A. In FIG. 11, an MPU 1000 performs a control procedure. A ROM 1001 stores a control procedure or the like shown in FIGS. 12 and 13. A RAM 1002 stores the present position of the carriage 111 or is used as a work area for executing the above control procedure. A timer 1003 measures an interval or the like for the ejection and recover operation in the present embodiment. In this embodiment, the operation of the timer is backed up by a battery.

A table shown below is usable for explaining the control for the ejection and recover operation in this embodiment. As illustrated in this table, time passing from the ejection and recover operation at the last time is examined while the power is turned on. If it is less than 26 hours, the ejection and recover operation is not done. If it is less than one month and not less than 26 hours, a once ejection and recover operation is performed. If it is not less than one month, three times ejection and recover operations are done. When it is found that the battery for backing up the timer is run out, once ejection and recover operation is conducted at once, since the passing time is uncertain.

Just before the cap opening, that is, when starting a recording, time passing from the ejection and recover operation at the preceding time is examined, if it is less than 34 hours, the ejection and recover operation is not executed. If it is not less than 34 hours and less than one month, the ejection and recover operation is carried out once. If it is not less than one month, three times ejection and recover operations are carried out.

TABLE

| | time lapse from last discharge | upon battery on | just before cap open |
|---|---|---|---|
| a | T < 26 hours | no discharge recover | no discharge recover |
| b | 26 hours ≦ T < 34 hours | discharge recover once | no discharge recover |
| c | 34 hours ≦ T < 1 month | discharge recover once | discharge recover once |
| d | 1 month ≦ T | discharge recover thrice | discharge recover thrice |
| e | battery run out | discharge recover once | no discharge recover |

In the above mentioned control manner of the discharge recover operation, in case where the discharge recover is effected upon the power being turned an when starting the work at 9 AM in the morning, the discharge recover is not effected at 9 AM in the next morning even if the power is turn on, since 26 hours has not lapsed. On the other hand, if the recording is started in the over time job after 10 hours has lapsed from the above with power being on, the discharge recover is effected once since 34 hours has been lapsed in total.

Figure 12:
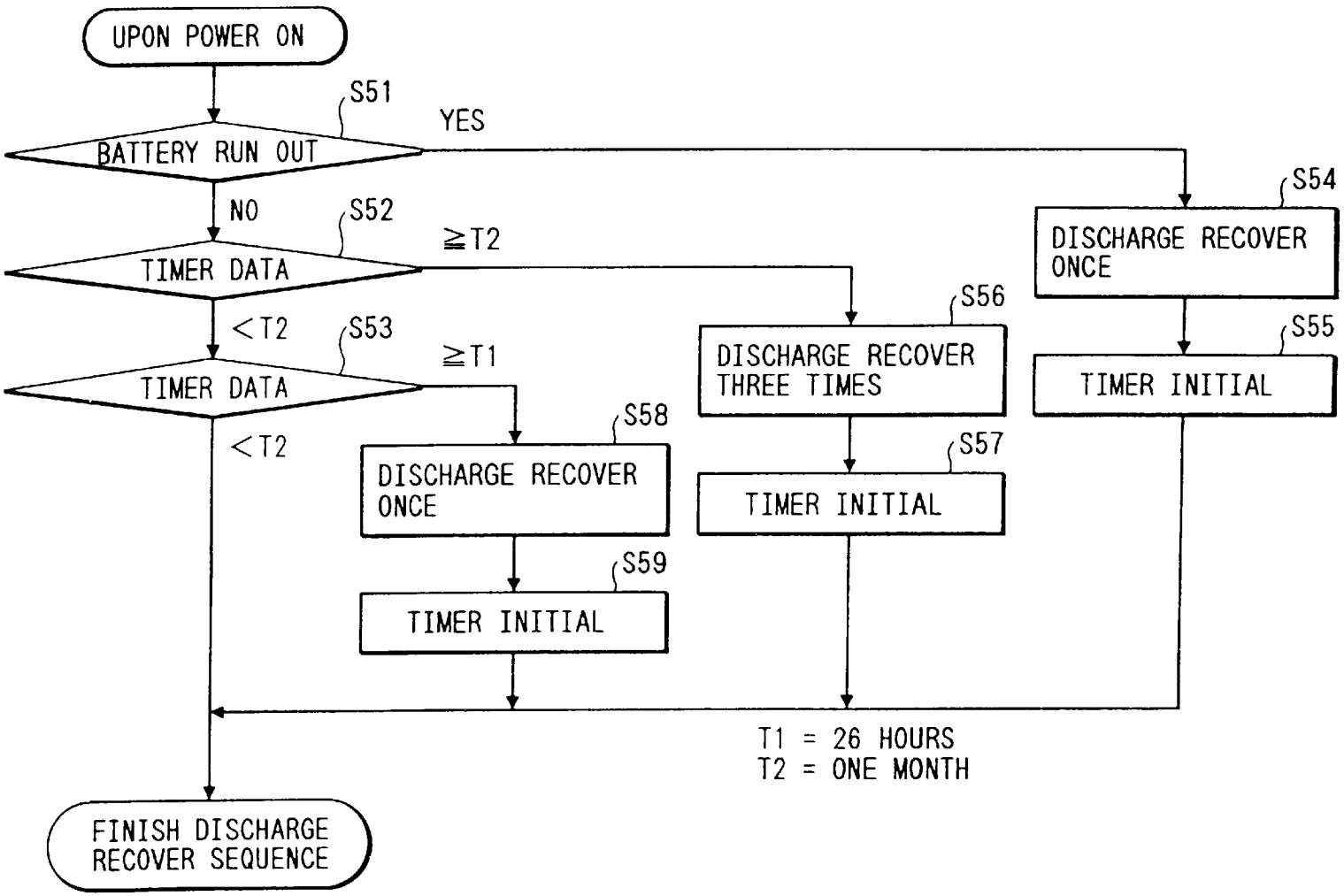

FIG. 12 in a flow chart showing the control procedure of the ejection and recover operation when the power is turned on, as explained in the above Table.

When this procedure starts, whether there is such an abnormality that the battery for backing up the timer 1003 is run out or not is first checked when the power is turned off, in a step S51. This battery check can be made according to a well known method. If the battery is in a normal state, the procedure proceeds to a step S52 to know the time passing from the ejection and recover operation at the last time based on the time counted by the timer 1003 and judge whether this time is a prescribed time T2 (one month in this embodiment) or more or not. According to this judgement, when It is judged that the elapsing time is less than one month, the procedure proceeds to a step S53 to judge whether this time is not less than a second prescribed time T1 (26 hours in this embodiment) or not. If the elapsing time is less than 26 hours, the ejection or discharge recover operation is not performed to finish the, procedure.

If it is judged that the elapsing time is not less than 26 hours in the step S53, the ejection recover operation is done once in a step S58.

Then, in a step S59, a timer for the elapsing time is reset to finish the present procedure. In the step B52, when it is judged that the elapsing time is one month or more, the ejection or discharge recover operation is performed three times in a step S56. After that, in a step S57, the timer is reset. Further, in the step S51, if it is judged that abnormal state such as a battery being run out, arises, the ejection or discharge recover operation is done once to make sure of safety in a step S54, because elapsing time from the turning off of power is uncertain. Then, the timer is reset in a step S55 to finish the present procedure.

Figure 13:
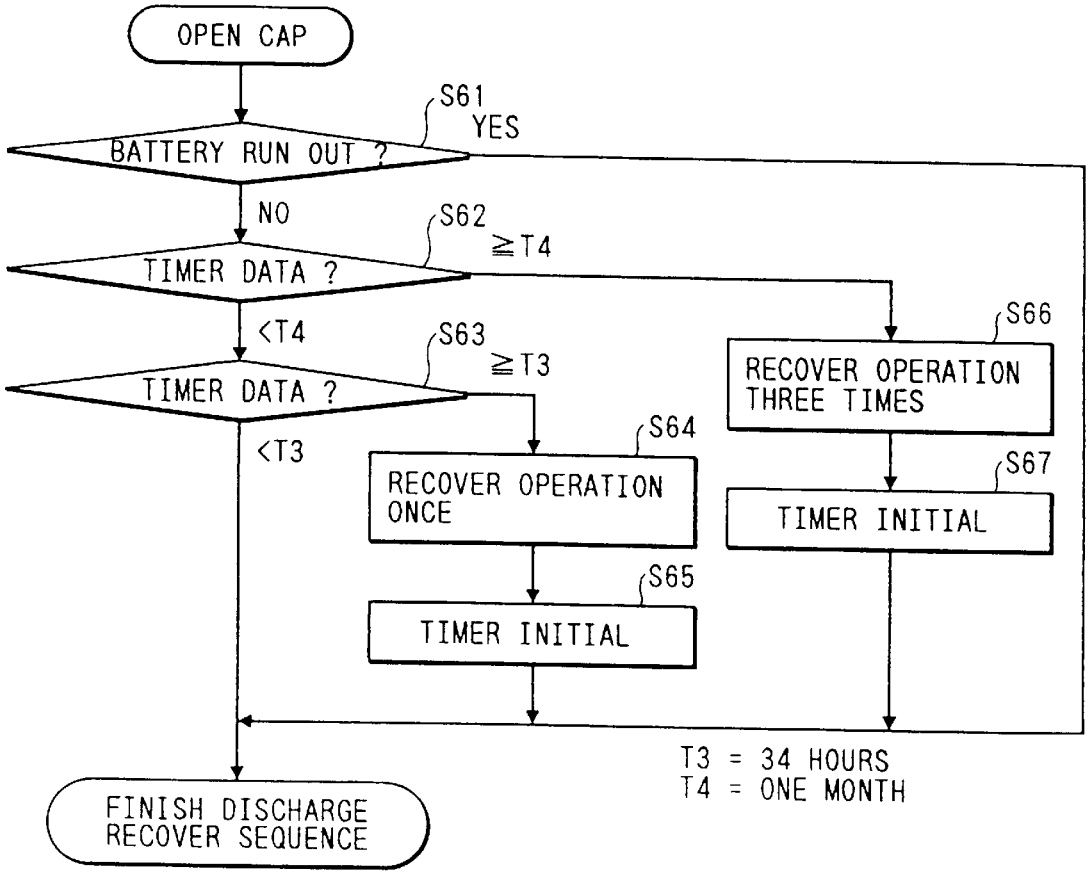

FIG. 13 is a flow chart of the ejection or discharge recover operation performed immediately before a capping means is released from the recording head to shift to a recording operation, when starting a recording, that is, when a recording is not performed.

When a recording instruction is outputted with the cap closed, the above ejection recover operation is started. In a step S61, the abnormality of the battery is checked. When the battery for backing up the timer is in a normal state, whether elapsing time from the recover operation of the last time is a prescribed time T4 (one month in the present embodiment) or more or not is judged. When it is judged that the elapsing time is less than one month, whether the elapsing time is a prescribed time T3 (34 hours in this embodiment) or more or not is judged in a step S63. If the elapsing time is less than 34 hours, the ejection or discharge recover operation is performed to finish the procedure.

When it is Judged that it is not less than 34 hours in the step 63, the recover operation is carried out once. Next, in a step 65, the timer it reset to finish the procedure. In the step 62, when it is judged that the elapsing time is one month or more, the ejection or discharge recover operation is performed three times in a step S66. Then, in a step 67, the timer is reset to finish the procedure. In the step S61, when it is judged that the battery is in an abnormal state, the ejection recover operation is not conducted to finish the procedure. In the present procedure, in case the ejection or discharge recover operation is to be executed, the procedure immediately shifts to a train of ejection recover operations after the sucking operation with the cap closed.

Although the number of the recover operations is varied according to the elapsing time in the above embodiment, the contents thereof may changed. For example, when the elapsing time is short, the sucking operation is not done but only the preliminary ejection or preliminary discharge may be conducted. This may be suitably determined in accordance with the specification of the recording head and circumstances where the recording head is employed.

It will be noted that the setting time or the number of times of the ejection or discharge recover operations which are references for the judgement of the elapsing time in the above embodiment are not limited to those values.

As for a stating point for counting the elapsing time, it may not be limited to the time when the recover operation of the preceding time is done but may be, for example, the time when the recording operation of the last time is finished or the time when the power is turned off.

As can be seen from the foregoing description, since the contents or the number of times of a train of ejection or discharge recover operations such as the suction of ink, the preliminary ejection, etc., which are performed upon turning power on or starting a recording may be variable in accordance with, for example, the elapsing time from the recover operation of the preceding time, an essentially required ejection recover operation can be performed accurately and properly.

As a result, the consumption of the ink necessary for the ejection recover operation, time taken for the recover operation, capacity of the waste tank, etc, can be minimized, In case the ejection recover operation is not performed when the power is turned off because of, for instance, the elapsing time, the ejection recover operation may be conducted as soon as the recording is started. In such a way, an appropriate recover operation can be performed by mutually compensating for the recover operations which are conducted respectively when the power is turned on and when the recording is started.

The present invention is particularly suitably usable in an ink jet recording head and recording apparatus which discharges the ink by usage of thermal energy.

This is because, the high density of the picture element, and the high resolution of the recording are possible, The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No, 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention, is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width, In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

According to the present invention, at least one side of the four sides of the orifice plates are not bonded with the front seal plate, and therefore, even if the front seal is influenced by the difference in the thermal expansions of various elements, the force applied to the orifice plate can be significantly reduced, and the deformation or the crack production of the orifice plate of the top plate can be prevented.

Therefore, the cause of the print quality degrading can be removed, and therefore, the ink jet recording head cartridge and an ink jet recording apparatus using the same can be provided which can produce high quality print reliably under various conditions.

While the invention has been described with reference to the structures disclosed herein, it is not confined to the details set forth and this application is intended to cover such modifications or changes as may come within the purposes of the improvements or the scope of the following claims.

What is claimed is:

1. An information processing apparatus comprising:

means for transmitting an image forming signal to a printer controlling portion of an ink jet printer for performing a printing operation to form an image on a recording medium by discharging ink in response to the image forming signal;

a keyboard; and a processing device for generating information used to create the image forming signal and for generating a predetermined signal different from the image forming signal and supplied to said printer controlling portion to effect a recovery operation for maintaining an ink discharging state of the ink jet printer, wherein the information processing apparatus counts an elapsed time from a time when a previous recovery operation was performed, at least one of a content and number of times the recovery operation is performed being varied by the predetermined signal based on the elapsed time.

2. An information processing apparatus according to claim 1, wherein power enabling the counting of elapsed time is backed up by a back-up power source.

3. An information processing apparatus according to claim 2, wherein the back-up power source is a battery.

4. An information processing apparatus according to claim 1, wherein the information processing apparatus is a computer.

5. An information processing apparatus according to claim 1, wherein the information processing apparatus is a word processor.

6. An information processing apparatus according to claim 1, wherein the information processing apparatus is facsimile equipment.

7. An information processing apparatus according to claim 1, wherein the information processing apparatus is a copying machine.

8. An ink jet printer comprising:

means for performing a printing operation to form an image on a recording medium by discharging ink in response to an image forming signal and for performing a recovery operation for maintaining ink discharging state of the ink jet printer in response to a predetermined signal different from the image forming signal;

a printer controlling portion for accepting the image forming signal and the predetermined signal; and means for receiving the image forming signal and the predetermined signal from an information processing apparatus having a keyboard and a processing device for generating information used to create the image forming signal and for generating the predetermined signal, wherein the information processing apparatus counts an elapsed time from a time when a previous recovery operation was performed, at least one of a content and number of times the recovery operation is performed being varied by the predetermined signal based on the elapsed time.

9. An ink jet printer according to claim 8, wherein the recovery operation is a preliminary ejection operation for ejecting from the ink jet printer ink which is not directly used for recording.

10. An ink jet printer according to claim 8, wherein the recovery operation is a sucking operation in which ink is sucked out of an ejection outlet of the ink jet printer using a cap covering the ejection outlet.

11. An ink jet printer according to claim 8, wherein the recovery operation is a pressuring operation in which ink retained in a passage communicating with an ejection outlet of the ink jet printer is pressed and discharged from the ejection outlet.

12. An ink jet printer according to claim 8, wherein the recovery operation is a wiping operation in which an ejection outlet of the ink jet printer and the periphery thereof are wiped by a blade.

13. An ink jet printer according to claim 8, further including an ink jet head with electrothermal transducers generating thermal energy for discharging the ink from the ejection outlet by generating film boiling in the ink.

14. An ink jet printer according to claim 8, wherein the printer is an electronic typewriter.

15. An information processing apparatus comprising:

means for transmitting an image forming signal to a printer controlling portion of an ink jet printer for performing a printing operation to form an image on a recording medium by discharging ink in response to the image forming signal;

a display; and a processing device for generating information used to create the image forming signal and for generating a predetermined signal different from the image forming signal and supplied to said printer controlling portion to effect a recovery operation for maintaining an ink discharging state of the ink jet printer, wherein the information processing apparatus counts an elapsed time from a time when a previous recovery operation was performed, at least one of a content and number of times the recovery operation is performed being varied by the predetermined signal based on the elapsed time.

16. An ink jet printer comprising:

means for performing a printing operation to form an image on a recording medium by discharging ink in response to an image forming signal and for performing a recovery operation for maintaining ink discharging state of the ink jet printer in response to a predetermined signal different from the image forming signal;

a printer controlling portion for accepting the image forming signal and the predetermined signal; and means for receiving the image forming signal and the predetermined signal from an information processing apparatus having a display and a processing device for generating information used to create the image forming signal and for generating the predetermined signal, wherein the information processing apparatus counts an elapsed time from a time when a previous recovery operation was performed, at least one of a content and number of times the recovery operation is performed being varied by the predetermined signal based on the elapsed time.

* * * * *

UNITED STATES PATENT AND TRADEMARK OFFICE

CERTIFICATE OF CORRECTION

PATENT NO. : 6,652,063 B1
DATED : November 25, 2003
INVENTOR(S) : Shimamura et al.

It is certified that error appears in the above-identified patent and that said Letters Patent is hereby corrected as shown below:

Column 5,
Line 12, “68” should read -- 58 --.
Line 44, “56” should read -- 55 --.

Column 8,
Line 35, “tho” should read -- the --; and
Line 60, “116” should read -- 115 --.

Column 9,
Line 66, “auction” should read -- suction --.

Column 10,
Line 5, “163” should read -- 153 --.

Column 11,
Line 17, “an” should read -- on --.

Signed and Sealed this

Eighteenth Day of April, 2006

JON W. DUDAS
*Director of the United States Patent and Trademark Office*